US012582919B2

(12) United States Patent
Girlya et al.

(10) Patent No.: US 12,582,919 B2
(45) **Date of Patent: *Mar. 24, 2026**

(54) AMUSEMENT ACTIVITY STATION

(71) Applicant: EPR Excavate, LLC, Kansas City, MO (US)

(72) Inventors: Ilya Girlya, West Berlin, NJ (US); Yan Girlya, West Berlin, NJ (US)

(73) Assignee: EPR Excavate, LLC, Kansas City, MO (US)

( * ) Notice: Subject to any disclaimer, the term of this patent is extended or adjusted under 35 U.S.C. 154(b) by 897 days.

This patent is subject to a terminal disclaimer.

(21) Appl. No.: 17/859,676

(22) Filed: Jul. 7, 2022

(65) Prior Publication Data

US 2024/0009580 A1 Jan. 11, 2024

(51) Int. Cl.
*A63G 31/02* (2006.01)

(52) U.S. Cl.
CPC ..... *A63G 31/02* (2013.01)

(58) Field of Classification Search
CPC ..... A63G 31/00; A63G 31/02; B66C 23/701; B66C 23/82; B66C 23/64
See application file for complete search history.

(56) References Cited

U.S. PATENT DOCUMENTS 2,590,188 A * 3/1952 Landree ..... A63H 33/3044 212/243
3,355,034 A * 11/1967 Holan ..... B66C 23/701 212/177
3,445,014 A * 5/1969 Kullerback ..... B60P 1/5433 414/742
3,456,810 A * 7/1969 Ely ..... B66C 23/94 340/685
3,664,515 A * 5/1972 Orendorff ..... B66C 23/94 212/292
3,685,673 A * 8/1972 Schweis ..... B60P 1/6472 414/547
3,777,900 A * 12/1973 Brewer ..... B66C 23/76 212/197
3,921,817 A * 11/1975 Petrik ..... F16C 19/362 212/181

(Continued)

*Primary Examiner* — Eugene L Kim
*Assistant Examiner* — Amir A Klayman
(74) *Attorney, Agent, or Firm* — Stinson LLP

(57) ABSTRACT

An amusement activity station enables a user to pick up and reposition machine-movable objects. The amusement activity station includes a crane apparatus and an operator gondola. The crane apparatus includes fixed pedestal and a movable boom apparatus. The boom apparatus is rotatable about a station axis of rotation and includes a bridge arm and an operable boom assembly. The boom assembly has a distal boom end and includes an object-to-boom linkage mechanism. The operator gondola is anchored to the bridge arm and provides a user-to-machine interface. The operator gondola is rotatable in unison with an upper machine portion by way of the bridge arm, and a roller enables movement of the operator gondola atop a support surface. The linkage mechanism links machine-movable objects to the distal boom end, and the boom assembly is maneuverable for lifting and repositioning the machine-movable objects by way of the user-to-machine interface.

20 Claims, 8 Drawing Sheets

(56) References Cited

U.S. PATENT DOCUMENTS

| | | | | | |
|---|---|---|---|---|---|
| 3,926,316 | A * | 12/1975 | Luttrell | B66C 23/48 | 414/710 |
| 3,997,061 | A * | 12/1976 | Sano | A63H 17/12 | 212/174 |
| 4,191,301 | A * | 3/1980 | Hickman | B66C 23/84 | 192/139 |
| 4,354,606 | A * | 10/1982 | Morrow | B66C 23/84 | 212/253 |
| 4,483,448 | A * | 11/1984 | Wittman | B66C 23/74 | 212/175 |
| 4,662,526 | A * | 5/1987 | Schaller | B66F 19/00 | 110/177 |
| 5,487,478 | A * | 1/1996 | Morrow | B66C 23/16 | 212/253 |
| 5,733,092 | A * | 3/1998 | Barry | B65G 63/045 | 212/319 |
| 6,491,174 | B1 * | 12/2002 | Day | B66C 23/52 | 212/253 |
| 8,863,966 | B2 * | 10/2014 | Bobeck | B66C 23/82 | 212/300 |
| 9,981,194 | B1 * | 5/2018 | Jennings | A63J 25/00 | |
| 10,865,076 | B1 * | 12/2020 | Schrank | B66C 23/166 | |
| 11,072,517 | B2 * | 7/2021 | Kundel, Sr. | B66C 23/66 | |
| 2002/0140171 | A1 * | 10/2002 | Ochi | G07F 17/3297 | 273/448 |
| 2009/0134107 | A1 * | 5/2009 | Doggett | B64G 4/00 | 212/239 |
| 2017/0113905 | A1 * | 4/2017 | Schroeder | B66C 23/022 | |

* cited by examiner

AMUSEMENT ACTIVITY STATION

BACKGROUND OF THE INVENTION

Field of the Invention

The present invention generally relates to an amusement park activity. More particularly, the present invention relates to amusement activity station by way of which user participants may operate machinery to pick up and reposition select objects by way of a crane apparatus.

Brief Description of the Prior Art

Amusement parks and theme parks continuously face challenges attracting return visitors and new visitors. Past visitors may elect to not return, and potential new visitors may elect to not travel to a park that, in their opinion, does not regularly offer guest experience components that are new, innovative or different relative to those of other parks. To be successful, amusement or theme park owners perceive a need to regularly introduce new, innovative and fun guest experiences. A primary objective according to the present invention is to provide an amusement activity station that is new, innovative, fun and different relative to prior art attractions.

A first exemplary amusement attraction is referenced in U.S. Pat. No. 10,166,485 ('485 patent) authored by Girlya et al. and owned by Diggerland USA, LLC in West Berlin, New Jersey. The '485 patent describes an amusement ride, attraction or device comprising a modified vehicle, machine, vessel, container, load-carrying platform or similar device, or any combination thereof, or anything having the appearance thereof, which is used, useful or operated for mining, transportation, military or construction or other commercial or industrial uses, purposes or applications. Illustrative embodiments of the invention include a modified dump trailer, dump truck or load-carrying platform. Such a modified dump trailer includes a dump trailer modified so as to permit a horizontally-pivoting telescoping hydraulic cylinder to raise and lower the front of the modified dump trailer, which is modified with a passenger support system and a passenger restraint system. Associated processes, systems and methods include a power pack or other dedicated source of energy and an adjacent entrance/exit ramp and boarding/de-boarding platform and operator control platform.

A second exemplary amusement attraction is referenced in U.S. Pat. No. 10,946,296 ('296 patent) also authored by Girlya et al. The '296 patent describes an amusement ride that provides user participants with the sensation of riding scissor lift construction equipment. The amusement ride has a scissor lift mechanism supported by a construction equipment frame with wheels thereon. A stationary support structure supports the equipment frame and suspends the wheels in midair to hold the equipment stationary. A cargo lift platform connected on top of the scissor lift mechanism has amusement ride seats mounted thereon. The ride seats have passenger restraints which provides amusement-ride-level safety. An electric motor drivingly connected to the scissor lift mechanism is operated by a ride operator to raise and lower the cargo lift platform. A passenger access platform situated adjacent the cargo lift platform allows ride passengers to easily and safely enter and exit the scissor lift.

From a consideration of the foregoing prior art examples, it will be noted that the prior art perceives a need for an amusement attraction that, instead of being passively ridden by a park guest, offers an opportunity to enable user participants to individually operate machinery in a safe, amusing manner. More particularly, the prior art perceives a need for an amusement activity station for enabling a user to operate machinery to pick up and reposition relatively heavy machine-moveable objects and thereby promote machinery operation skills as summarized in more detail hereinafter.

SUMMARY OF THE INVENTION

As prefaced above, a primary objective of this invention is the provision of an amusement activity station for enabling an operator or passenger user to operate machinery to pick up and reposition certain machine-movable objects for promoting machinery operation skills. The basic invention may be said to essentially teach or disclose an amusement activity station comprising, in combination a crane apparatus and an operator gondola. The crane apparatus according to the present invention essentially comprises a lower fixed portion or assembly support pedestal and an upper movable portion or boom assembly. The lower fixed portion or pedestal is anchored to a support surface.

The upper movable portion or boom apparatus comprises a pedestal interface and an upper machine portion. The pedestal interface is anchored to the lower fixed portion or pedestal. The upper machine portion is rotatable or pivotal relative to the pedestal interface about a station axis of rotation and comprises a bridge arm and an operable boom assembly. The operable boom assembly comprises a distal boom end and an object-to-boom linkage mechanism.

The operator gondola is attached or anchored to the bridge arm and comprises a user-to-machine interface and certain roller means for movement. The operator gondola is pivotal or rotatable in unison with the movable machine portion by way of the bridge arm. The roller means for movement enable movement of the operator gondola atop the support surface. The object-to-boom linkage mechanism links at least one machine-movable object to the distal boom end. The operable boom assembly is maneuverable for lifting the machine-movable object(s) from the support surface by way of the user-to-machine interface as manually operated by the user. The movable portion or boom apparatus moves the machine-movable object to a target location.

The crane apparatus may further preferably comprise a winch apparatus. The winch apparatus preferably comprises a winch motor and a winch line. Together, the winch motor and winch line enable the user to selectively vary the distance of the object-to-boom linkage mechanism relative to the distal boom end. The operable boom assembly may further preferably comprise a primary boom arm and a telescopic boom arm. The telescopic boom arm is extendable and retractable relative to the primary boom arm for adjusting an effective length of the operable boom assembly. Together the winch assembly and the boom assembly aid the user in particularly directing the object-to-boom linkage mechanism for picking up and repositioning the machine-movable objects.

The upper movable machine portion may further preferably comprise a rotational movement limit mechanism for limiting rotational or pivotal movement of the upper machine portion relative to the fixed portion or pedestal interface. The rotational movement limit mechanism is preferably characterized by at least one limit switch assembly. The limit switch assembly may be said to comprise a switch mechanism and at least one switch stop. The switch mechanism comprises a switch lever that is directable into the at least one switch stop for switching off power directed to the upper machine portion and limiting rotational movement of the upper machine portion relative to the pedestal interface. The switch stops are fixedly attached to the pedestal interface and the switch mechanism is mounted on the upper machine portion for limiting rotational movement within a select arc range, the select arc range being between 45 and 90 rotational degrees in a preferred embodiment.

The roller means for movement are preferably characterized by a wheel assembly attached to a floor or undercarriage of the operator gondola. Together, the bridge arm and the wheel assembly support the operator gondola atop the support surface with the wheel assembly enabling roller movement of the operator gondola atop the support surface. The operator gondola may further preferably comprise a shield feature for providing a user-protective barrier between the user and the crane apparatus. The shield feature may further preferably comprise a grating for preventing physical access to the crane apparatus while permitting visual perception of the crane apparatus.

Other secondary objects of the present invention, as well as particular features, elements, and advantages thereof, will be elucidated or become apparent from, the following brief descriptions of the drawings and the accompanying drawing figures.

BRIEF DESCRIPTIONS OF THE DRAWINGS

Other features and objectives of the invention will become more evident from a consideration of the following brief descriptions of patent drawings.

FIG. 1 is a first sequential side elevational view of a basic amusement activity station according to the present invention showing a machine-movable object adjacent an operator gondola/crane apparatus combination with a boom assembly of the crane apparatus being shown in a fully raised extended configuration.

FIG. 2 is a second sequential side elevational view of the basic amusement activity station according to the present invention showing the machine-movable object adjacent the operator gondola/crane apparatus combination with the boom assembly of the crane apparatus being shown in a lowered partially extended configuration with an object-to-boom linkage mechanism of the boom assembly linking with the machine-movable object.

DETAILED DESCRIPTION OF THE PREFERRED EMBODIMENT

Figure 1:
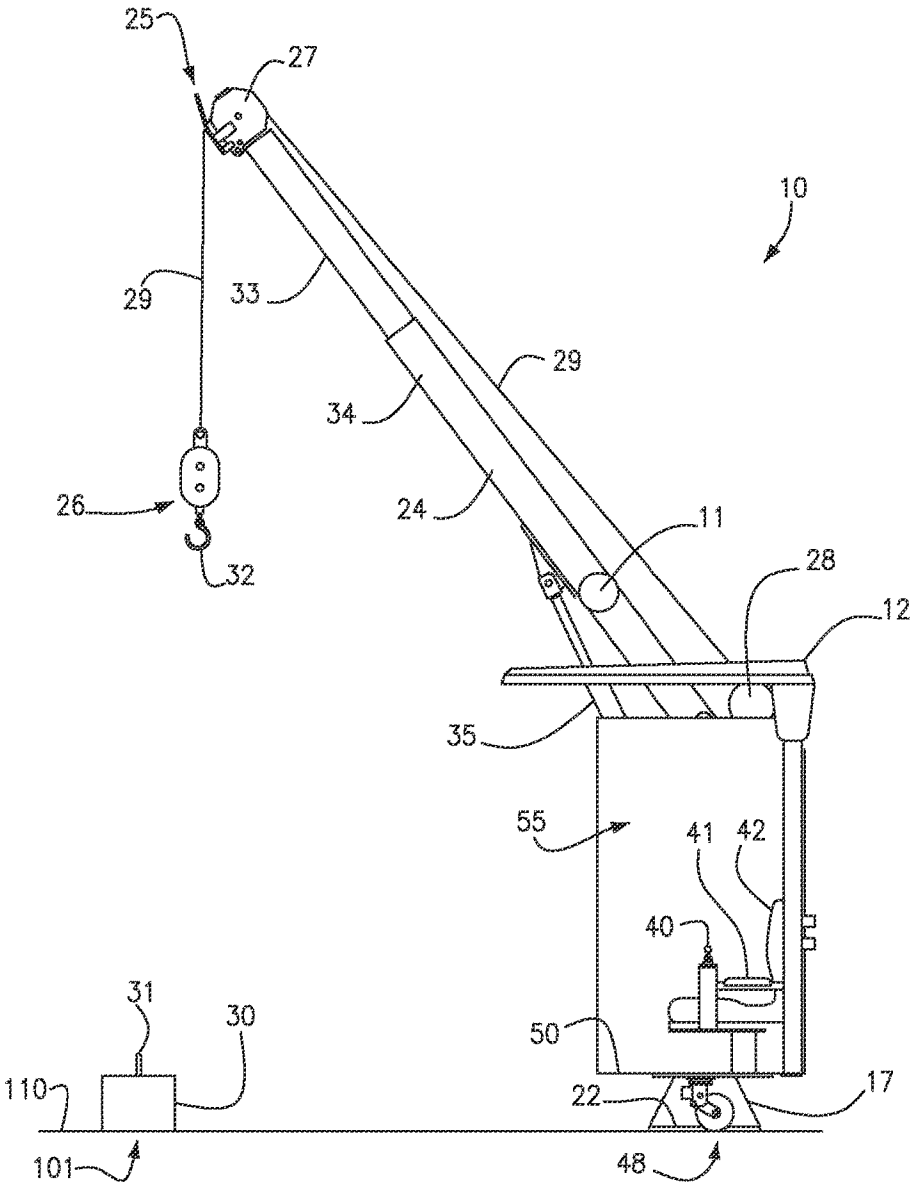
Figure 2:
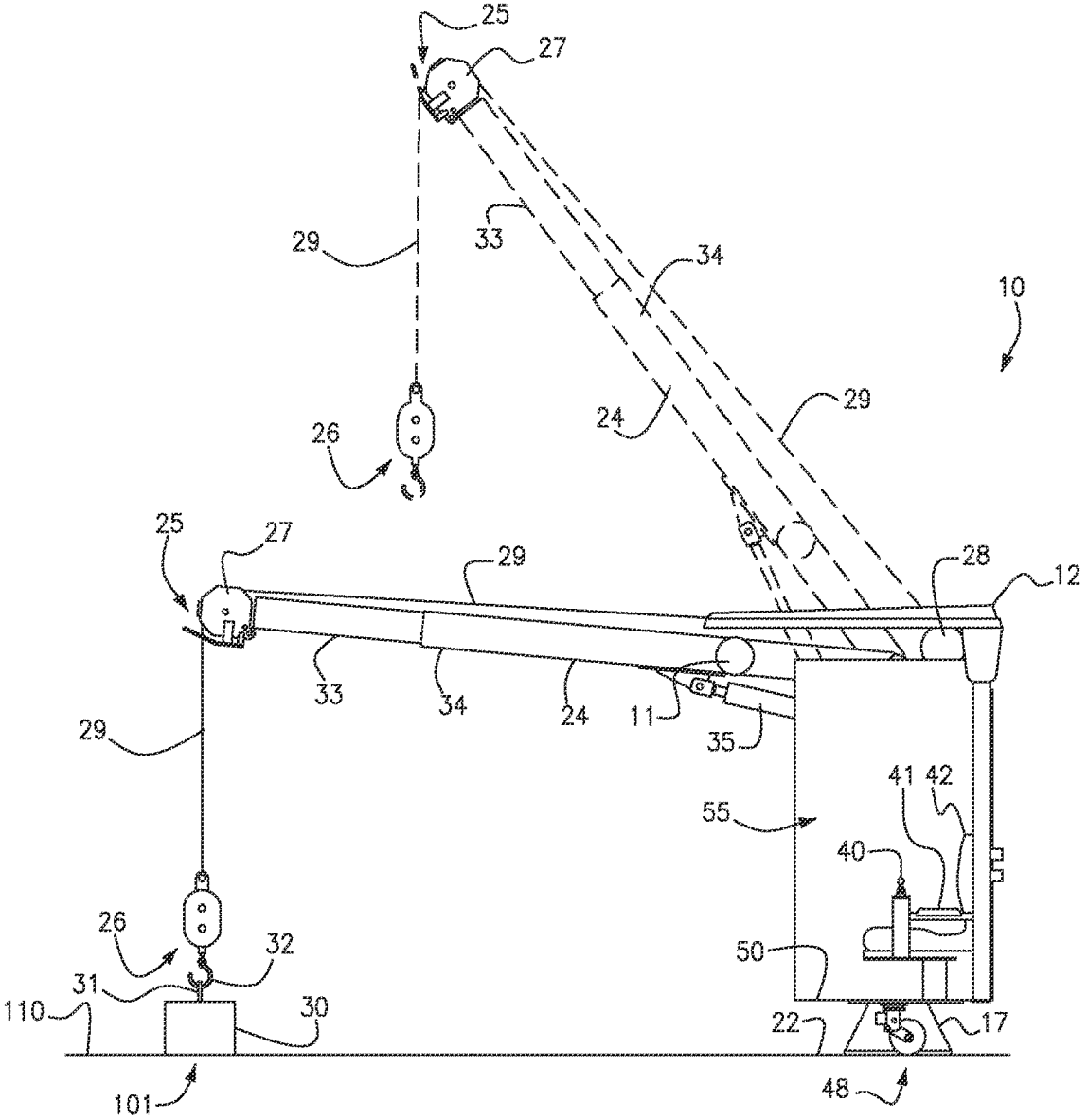
Figure 3:
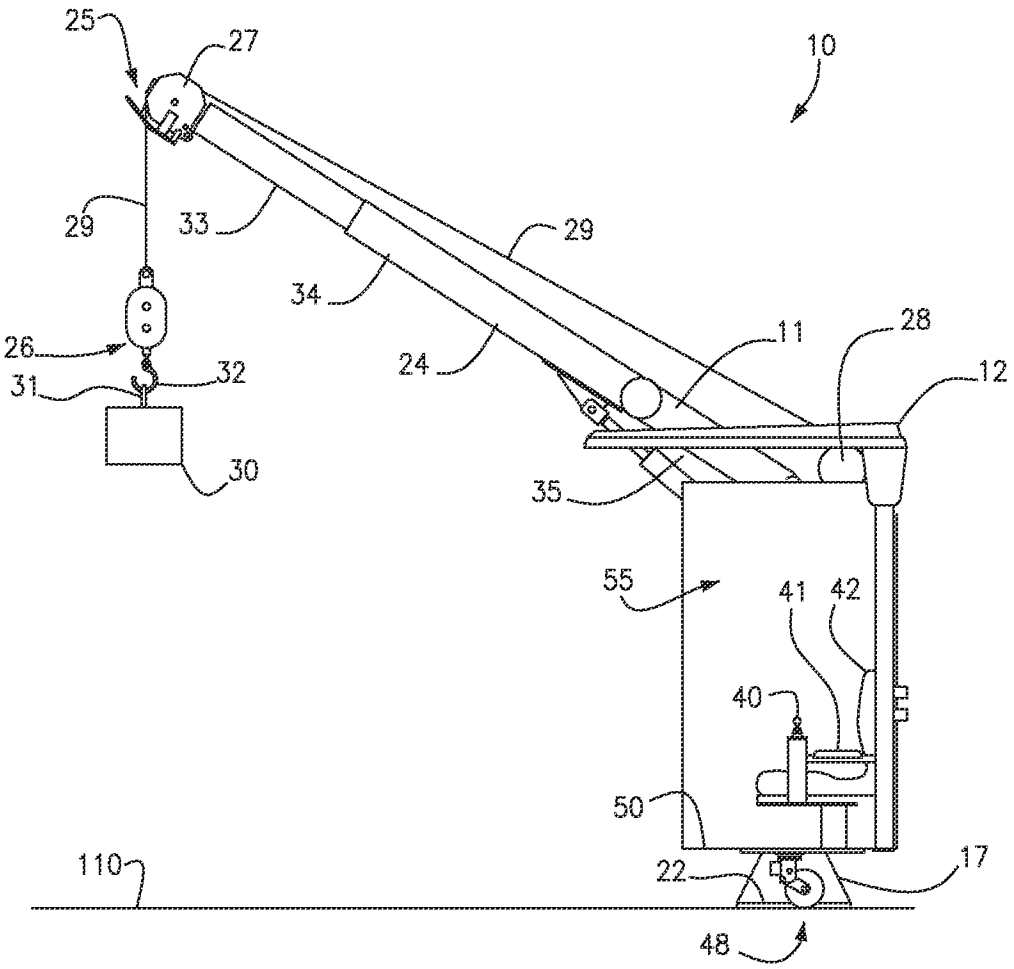
FIG. 3 is a third sequential side elevational view of the basic amusement activity station according to the present invention showing the machine-movable object raised by way of the operator gondola/crane apparatus combination with the boom assembly of the crane apparatus being shown in a partially raised, partially extended configuration.

Referring now to the drawings with more specificity, the following specifications generally describe an amusement activity station 10 for enabling an operator or passenger user to pick up and reposition relatively heavy, machine-movable objects for generally offering user participants an opportunity to individually operate machinery in a safe, amusing or entertaining manner. The amusement activity station according to the presently disclosed subject matter generally amuses or entertains user participants while more particularly enabling user participants to operate machinery to promote machinery operation skills in an amusing manner.

The amusement activity station 10 according to the present invention preferably comprises a modified or simplified crane apparatus as at 11 and an attached operator compartment or operator gondola as at 12. The crane apparatus 11 and the operator compartment or operator gondola 12 are attached to one another at a rigid (steel) bridge arm 13 integrally formed as part of the crane apparatus 11, which bridge arm 13 is preferably sandwiched intermediate an upper gondola flange 14 and a lower gondola flange 15 with a series of fasteners or bolts 16 attaching the gondola flanges 14/15 to the bridge arm 13 in a preferred embodiment.

The crane apparatus 11 according to the present invention preferably further comprises a lower apparatus-anchoring boom assembly support pedestal as at 17 and an upper operable, movable boom apparatus or boom assembly as at 18. A lower pedestal end 22 of the lower apparatus-anchoring boom assembly support pedestal 17 is fixedly attached or anchored to a support surface as at 110 preferably exemplified by a concrete slab to which the boom assembly support pedestal 17 is anchored as at bolts 19. The upper operable, movable boom apparatus 18 preferably comprises a pedestal interface as at 20 and an upper machine portion as at 21. The pedestal interface 20 is anchored or fixedly attached to an upper pedestal end 23 of the boom assembly support pedestal 17. The upper machine portion 21 is rotatable relative to the pedestal interface 20 about a station axis of rotation 100 and comprises the bridge arm 13 and an operable primary boom assembly as at 24. The primary boom assembly 24 preferably comprises a distal boom end 25, an object-to-boom linkage mechanism exemplified by a sheave-hook assembly 26, and a primary boom arm as at 34. In a preferred embodiment, the distal boom end 25 may be further outfitted with an end-mounted sheave 27.

The crane apparatus 11 may further preferably comprise a winch assembly to add functionality to the amusement activity station 10. The winch assembly preferably comprises a winch motor as at 28 and a winch line as at 29. The winch motor 28 and winch line 29 enable the operator or passenger user to selectively vary the distance of the object-to-boom linkage mechanism relative to the distal boom end 25, and are sufficiently rated to support lifting movements of relatively heavy, machine-movable objects 30 exemplified by cylinders or cribbing blocks outfitted with a linkage feature matable with the object-to-boom linkage mechanism. In the preferred embodiment, the machine-movable objects 30 are each outfitted with a loop member 31 that may engage or mate with the hook member 32 of the sheave-hook assembly 26.

Figure 5:
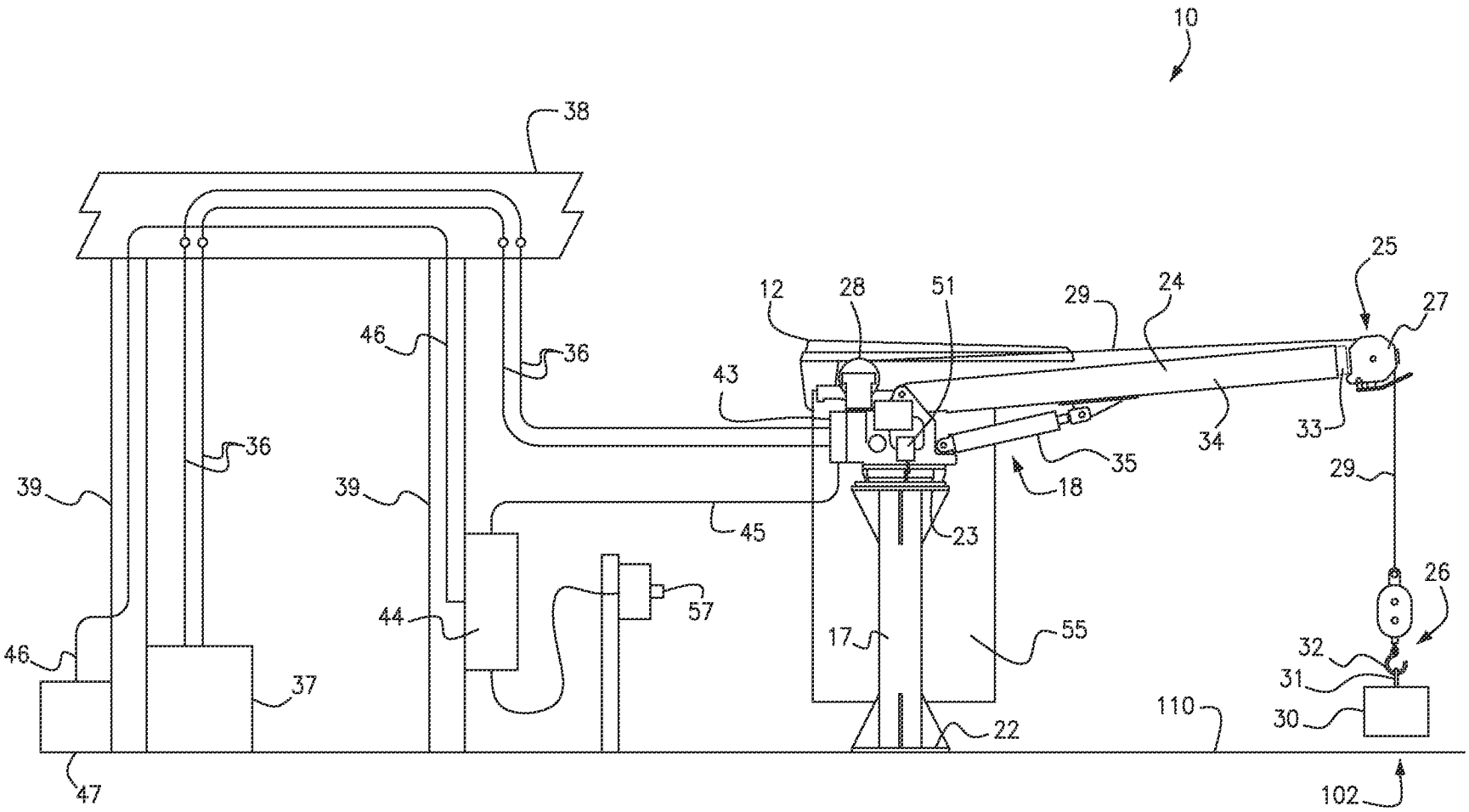
FIG. 5 is a side elevational view of the basic amusement activity station according to the present invention showing the machine-movable object repositioned at the second location with the boom assembly of the crane apparatus being shown in a lowered, fully retracted configuration and support systems being diagrammatically depicted in communication with the amusement activity station.

The primary boom assembly 24 preferably further comprises a telescopic boom arm as at 33 for varying the distance of the distal boom end 25 relative to the operator gondola 12. Two hydraulic cylinders, driven by a peripheral hydraulic support system, operate to (1) raise and lower the primary boom arm 34 and (2) extend and retract the telescopic boom arm 33 relative to the primary boom arm 34. A first of the hydraulic cylinders is depicted and referenced at 35. Hydraulic cylinder 35 is operable to raise and lower the primary boom arm 34, and a second of the hydraulic cylinders is positioned within the primary boom arm 34 and concealed from view. The second hydraulic cylinder operates to extend and retract the telescopic boom arm 33 relative to the primary boom arm 34. Hydraulic lines 36 are generically shown attaching to the boom apparatus 18 and are connected to an external electrically powered hydraulic power pack 37 preferably via an overhead delivery structure 38 supported by upright posts 39 as depicted and referenced in FIG. 5. The overhead delivery structure 38 may provide a support structure for positioning support systems to a series of amusement activity stations (not specifically illustrated).

As prefaced above, the operator gondola 12 or passenger/user compartment is anchored or attached to the bridge arm 13 and preferably comprises a user-to-machine interface and roller means for movement. The user-to-machine interface is preferably exemplified by a pair of hand controls or joysticks as at 40 positioned adjacent armrests 41 and a seat 42 on the operator gondola 12. The hand controls 40 are maneuverable to control various functions of the amusement activity station 10 through a programmable logic control center 43 mounted to the rear portion of the upper machine portion 21. The programmable logic control center 43 is in electric communication as at 45 with a power inverter 44 in electrical communication as at 46 with an external power source 47 to drive the controls 40 and safety features, inclusive of an emergency stop switch as at 57.

The hand controls 40 are operable to raise and lower the primary boom arm 34; extend and retract the telescopic boom arm 33 relative to the primary boom arm 34; extend and retract the winch line 29 via the winch motor 28; and pivot the upper machine portion 21 and operator gondola 12 about the station axis of rotation 100. The operator gondola 12 rotates in unison with the upper machine portion 21 by way of the bridge arm 13. The roller means for movement, mounted to the undercarriage or floor 50 of the operator gondola 12, enable rolling movement of the operator gondola 12 atop the support surface 110. The roller means for movement are preferably exemplified by a single caster or wheel assembly as at 48 mounted at a lateral portion 49 of the operator gondola 12 opposite the boom assembly support pedestal 17 and is dimensioned for supporting the floor 50 of the operator gondola 12 in parallel relation to the support surface 110.

Figure 4:
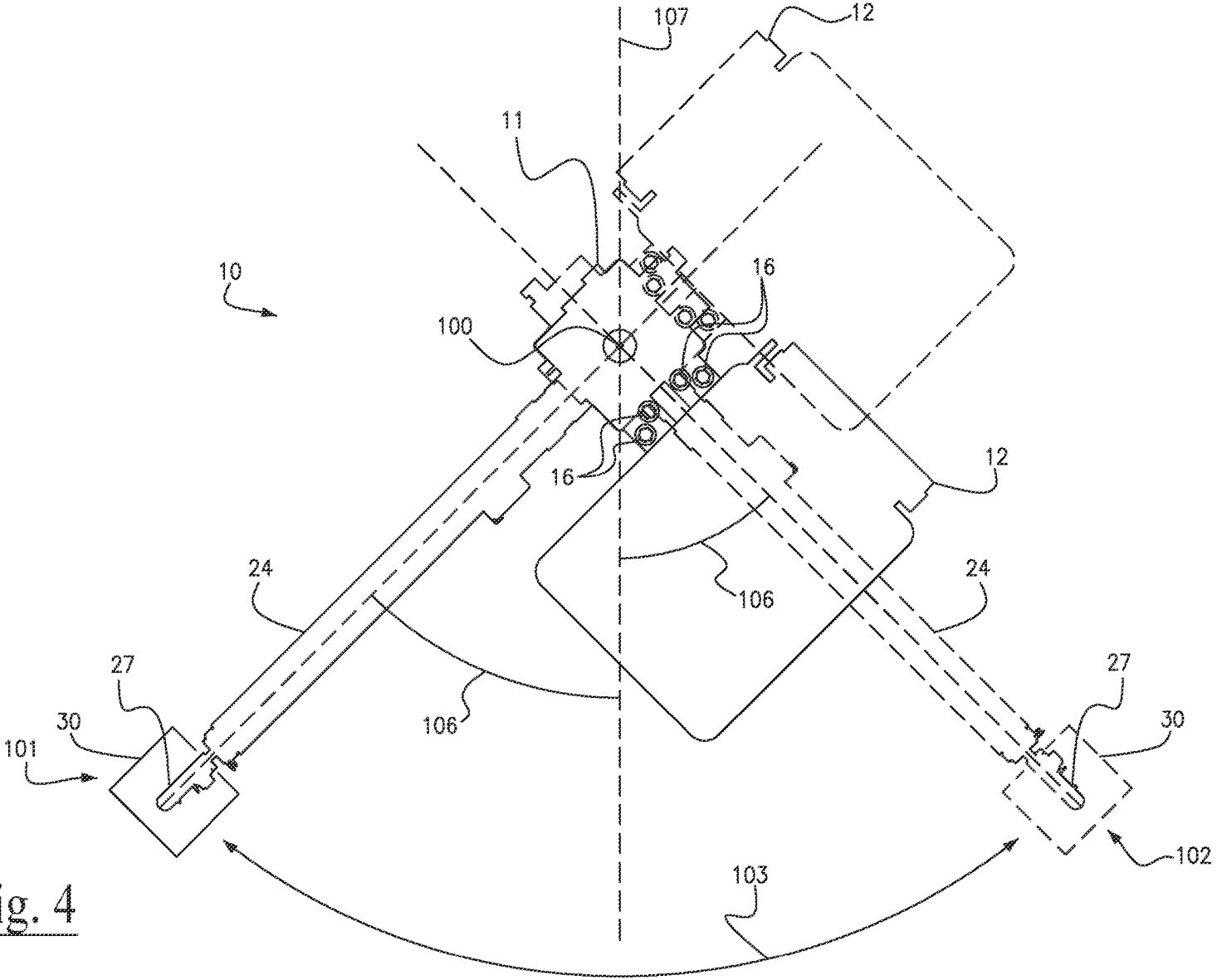
FIG. 4 is a fourth sequential top view of the basic amusement activity station according to the present invention showing the machine-movable object being repositioned from a first location to a second location by way of the operator gondola/crane apparatus combination.

The object-to-boom linkage mechanism is directable by way of the controls 40, including extension and retraction of the winch line 29; extension and retraction of the telescopic boom arm 33; and raising and lowering of the primary boom arm 34. The object-to-boom linkage mechanism, preferably comprising a hook member 32, may link, couple, or mate with a series of machine-movable objects 30, for lifting the object(s) 30 and repositioning the objects 30 by moving the objects 30 through a select arc length 103 as generally depicted in FIG. 4. In this regard, the amusement activity station 10 pivots about the station axis of rotation 100 for picking up objects 30 from a first location as at 101 and repositioning the objects at a second target location as at 102 generally moving through the select arclength 103. The select arclength 103 is structurally defined or limited by a limit switch feature or switch mechanism as at 51 in cooperative association with a pair of switch stops 53/54.

Figure 7C:
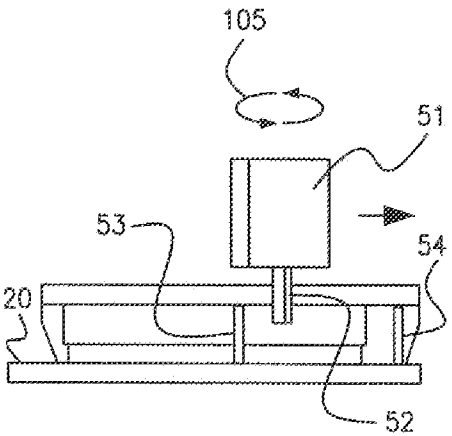
FIG. 7C is a third sequential schematic side depiction of the upper limit switch being rotationally directed in a counterclockwise direction with the depending switch lever of the limit switch being directed toward a lower fixed second switch stop.
Figure 7B:
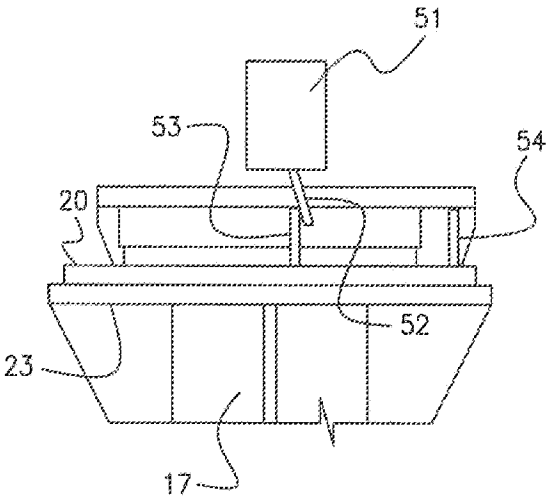
FIG. 7B is a second sequential schematic side depiction of the upper limit switch being rotationally stopped by way of the depending switch lever of the limit switch as directed into an off position by way of the lower fixed first switch stop.
Figure 7A:
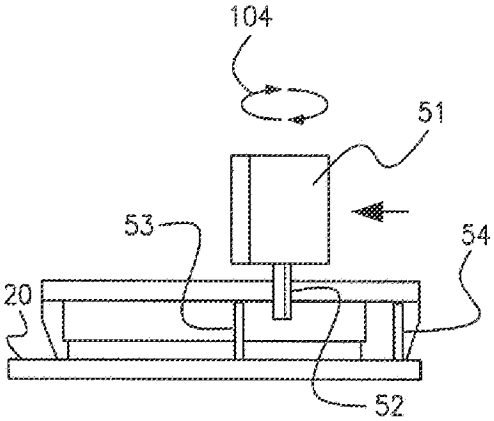
FIG. 7A is a first sequential schematic side depiction of an upper limit switch being rotationally directed in a clockwise direction with a depending switch lever of the limit switch being directed toward a lower fixed first switch stop.
Figure 7D:
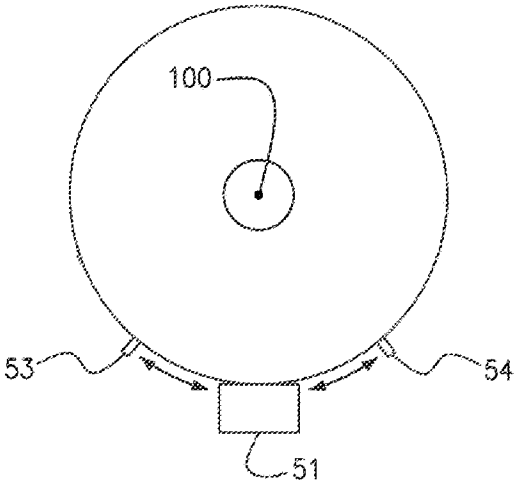
FIG. 7D is a top schematic view of upper rotational portions of the crane apparatus outfitted with the limit switch centrally located relative to the lower fixed first and second switch stops.
Figure 8:
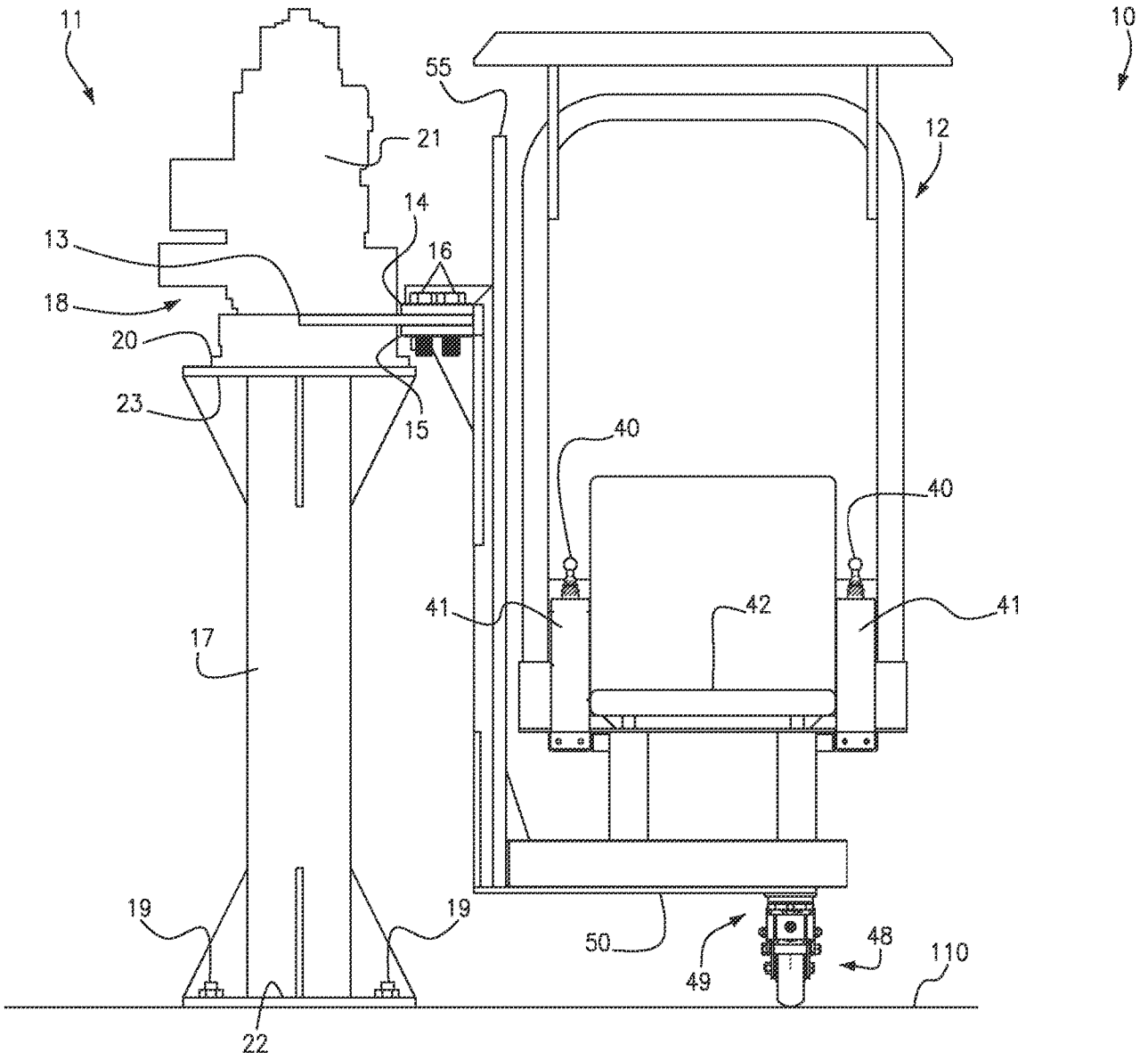
FIG. 8 is a frontal elevational view of the amusement activity station according to the present invention showing a lower boom assembly support pedestal with an outline of an upper boom assembly supported by the boom assembly support pedestal and an operator gondola attached to the upper boom assembly by way of a bridge arm.

Comparatively referencing FIGS. 7A through 7D, the reader will there consider the limit switch mechanism 51 mounted on the upper machine portion 21 and in electrical communication with the programmable logic control center 43. When the upper machine portion 21 rotates clockwise as at 104 a downwardly extending or depending spring-biased switch lever 52 of the limit switch mechanism 51 is directed towards a first upwardly extending stop member or switch stop 53 mounted on the fixed pedestal interface 20 as generally depicted in FIG. 7A. When the switch lever 52 is moved to a first off position by way of the fixed switch stop 53 as depicted in FIG. 7B, rotational power to the upper machine portion 21 is prevented and the upper machine portion 21 is unable to further rotate in a clockwise direction 104.

Referencing FIG. 7C, the reader will there see the upper machine portion 21 rotating in a counterclockwise direction 105 under directional control of the operator via the hand controls 40. The switch lever 52 returns to a relaxed position and is directed toward a second upwardly extending stop member or switch stop 54 preferably mounted on the pedestal interface 20 at a position roughly 90 rotational degrees from the first upwardly extending stop member 53 for limiting rotational movement of the upper machine portion 21 and operator gondola 12 to forty-five (45) rotational degrees as at angles 106 on either side of a medial plane 107.

The stop members 53 and 54 may be mounted in different locations for altering the effective select arclength 103. However, in a preferred embodiment, it is contemplated that an arclength 103 coinciding with an arc range between 45 and 90 rotational degrees is optimal. The reader will thus understand the upper machine portion 21 preferably comprises a rotational movement limit mechanism for limiting rotational movement of the upper machine portion 21 relative to the pedestal interface 20, which rotational movement limit mechanism is preferably exemplified or characterized by the cooperative functionality of the limit switch mechanism 51 and the stop members 53/54.

Figures 6, 6A:
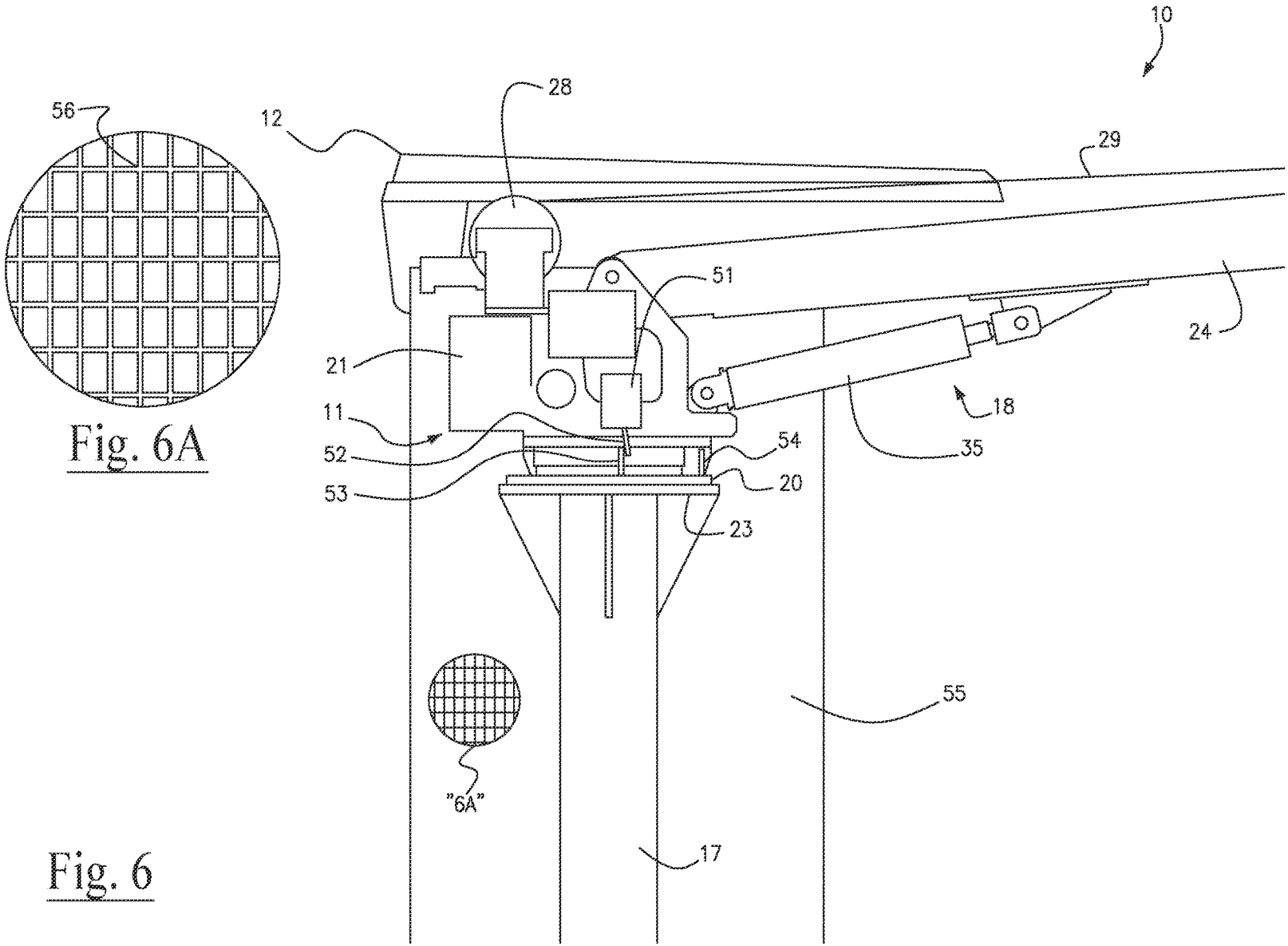
FIG. 6 is an enlarged fragmentary side view of upper portions of the amusement activity station according to the present invention enlarged to show in greater detail central portions of the crane apparatus.
FIG. 6A is an enlarged sectional view as enlarged and sectioned from FIG. 6 to show in greater detail grating from the operator gondola of the amusement activity station according to the present invention.

The operator gondola 12 may further preferably comprise a shield member or feature as at 55. The shield feature 55 provides a user-protective or operator-protective barrier between the operator or passenger user and the crane apparatus 11. In a preferred embodiment, the shield feature 55 comprises or provides a grating as generally comparatively depicted and referenced in FIGS. 6 and 6A. The grating 56 prevents physical access to the crane apparatus 11 and associated support systems while permitting visual perception of the crane apparatus 11 and its support systems for enhancing the overall amusing effect of the amusement activity station 10.

While the above descriptions contain much specificity, this specificity should not be construed as limitations on the scope of the invention, but rather as an exemplification of the invention. The basic invention may be said to essentially teach or disclose an amusement activity station for enabling a user to pick up and reposition machine-movable objects to promote machinery operation skills. The amusement activity station according to the present invention may be said to essentially comprise a crane apparatus and an operator gondola.

The crane apparatus according to the present invention essentially comprises a lower fixed portion or assembly support pedestal and an upper movable portion or boom assembly. The lower fixed portion or pedestal is anchored to a support surface. The upper movable portion or boom apparatus comprises a pedestal interface and an upper machine portion. The pedestal interface is anchored to the lower fixed portion or pedestal. The upper machine portion is rotatable relative to the pedestal interface about a station axis of rotation and comprises a bridge arm and an operable boom assembly. The operable boom assembly comprises a distal boom end and an object-to-boom linkage mechanism.

The operator gondola is attached or anchored to the bridge arm and comprises a user-to-machine interface and certain roller means for movement. The operator gondola is pivotal or rotatable in unison with the movable machine portion by way of the bridge arm. The roller means for movement enable movement of the operator gondola atop the support surface. The object-to-boom linkage mechanism links at least one machine-movable object to the distal boom end. The operable boom assembly is maneuverable for lifting the machine-movable object(s) from the support surface by way of the user-to-machine interface as manually operated by the user. The movable portion or boom apparatus moves the machine-movable object to a target location.

The crane apparatus may further preferably comprise a winch apparatus. The winch apparatus preferably comprises a winch motor and a winch line. Together, the winch motor and winch line enable the user to selectively vary the distance of the object-to-boom linkage mechanism relative to the distal boom end. The operable boom assembly may further preferably comprise a primary boom arm and a telescopic boom arm. The telescopic boom arm is extendable and retractable relative to the primary boom arm for adjusting an effective length of the operable boom assembly. Together the winch assembly and the boom assembly aid the user in particularly directing the object-to-boom linkage mechanism for picking up and repositioning the machine-movable objects.

The upper movable machine portion may further preferably comprise a rotational movement limit mechanism for limiting rotational or pivotal movement of the upper machine portion relative to the fixed portion or pedestal interface. The rotational movement limit mechanism is preferably characterized by at least one limit switch assembly. The limit switch assembly may be said to comprise a switch mechanism and at least one switch stop. The switch mechanism comprises a switch lever that is directable into the at least one switch stop for switching off power directed to the upper machine portion and limiting rotational movement of the upper machine portion relative to the pedestal interface. The switch stops are fixedly attached to the pedestal interface and the switch mechanism is mounted on the upper machine portion for limiting rotational movement within a select arc range, the select arc range being between 45 and 90 rotational degrees in a preferred embodiment.

The roller means for movement are preferably characterized by a wheel assembly attached to a floor or undercarriage of the operator gondola. Together, the bridge arm and the wheel assembly support the operator gondola atop the support surface with the wheel assembly enabling roller movement of the operator gondola atop the support surface. The operator gondola may further preferably comprise a shield feature for providing a user-protective barrier between the user and the crane apparatus. The shield feature may further preferably comprise a grating for preventing physical access to the crane apparatus while permitting visual perception of the crane apparatus.

The foregoing embodiments illustrate the principles, preferred or example embodiments, and modes of assembly and operation, of the invention. It is noted, however, the invention is not, and shall not be construed as being exclusive or limited to the specific or particular embodiments herein. Moreover, certain specific or particular embodiments herein have been expressly designated optional, and thus the invention includes the invention with, or without, any or all embodiments herein expressly designated as optional.

Accordingly, all embodiments herein should be regarded as illustrative rather than exclusive or limiting, and variations to embodiments herein may be made without departing from the invention scope. In other words, although the amusement activity station according to the present invention have been described by reference to a number of different embodiments, it is not intended that the novel combinations or assemblies be limited thereby, but that modifications thereof are intended to be included as falling within the broad scope and spirit of the foregoing disclosure, the appended drawings, and perhaps most importantly, the following claims.

What is claimed is:

1. An amusement activity station operable to pick up and reposition machine-movable objects, the amusement activity station comprising:

a crane apparatus comprising a lower fixed pedestal and an upper movable boom apparatus, the lower fixed pedestal configured to be anchored to a support surface, the upper movable boom apparatus comprising a pedestal interface and an upper machine portion, the pedestal interface being anchored at the lower fixed pedestal, the upper machine portion being rotatable relative to the pedestal interface about a station axis of rotation and comprising a bridge arm and an operable boom assembly, the operable boom assembly comprising a distal boom end and an object-to-boom linkage mechanism; and an operator gondola separate from the upper machine portion and anchored to the upper machine portion by the bridge arm, the bridge arm extending laterally outward from the station axis of rotation to space the gondola from the station axis of rotation and the lower fixed pedestal, the gondola comprising a user-to-machine interface and at least one wheel configured to engage the support surface, the operator gondola being rotatable in unison with the upper machine portion by way of the bridge arm, the operator gondola configured to rotate around the station axis of rotation and the lower fixed pedestal, the object-to-boom linkage mechanism configured to link at least one machine-movable object to the distal boom end, the operable boom assembly being maneuverable for lifting the at least one machine-movable object from the support surface by way of the user-to-machine interface as manually operated by the user.

2. The amusement activity station of claim 1 wherein the crane apparatus comprises a winch apparatus, the winch apparatus comprising a winch motor and a winch line, the winch motor and winch line for selectively varying the distance of the object-to-boom linkage mechanism relative to the distal boom end.

3. The amusement activity station of claim 1 wherein the operable boom assembly comprises a primary boom arm and a telescopic boom arm, the telescopic boom arm being extendable and retractable relative to the primary boom arm for adjusting an effective length of the operable boom assembly.

4. The amusement activity station of claim 1 wherein the upper machine portion comprises a rotational movement limit mechanism for limiting rotational movement of the upper machine portion relative to the pedestal interface.

5. The amusement activity station of claim 4 wherein the rotational movement limit mechanism is characterized by at least one limit switch assembly, the limit switch assembly comprising a switch mechanism and at least one switch stop, the switch mechanism comprising a switch lever, the switch lever being directable into the at least one switch stop for switching off power directed to the upper machine portion and limiting rotational movement of the upper machine portion relative to the pedestal interface.

6. The amusement activity station of claim 5 wherein the at least one switch stop is mounted to the pedestal interface and the switch mechanism is mounted on the upper machine portion.

7. The amusement activity station of claim 6 comprising a pair of switch stops, the switch stops being mounted on the pedestal interface for limiting rotational movement within a select arc range, the select arc range being between 45 and 90 rotational degrees.

8. The amusement activity station of claim 1 wherein the at least one wheel is attached to a floor of the operator gondola, wherein the bridge arm and the at least one wheel are configured to support the operator gondola atop the support surface.

9. The amusement activity station of claim 1 wherein the operator gondola comprises a shield feature, the shield feature providing a user-protective barrier between the user and the crane apparatus.

10. The amusement activity station of claim 9 wherein the shield feature comprises a grating, the grating preventing physical access to the crane apparatus while permitting visual perception of the crane apparatus.

11. An amusement activity station operable to reposition machine-movable objects, the amusement activity station comprising:

a crane apparatus comprising a fixed portion and a movable portion, the fixed portion configured to be anchored to a support surface, the movable portion being pivotal relative to the fixed portion about a station axis of rotation and comprising a bridge arm and a boom assembly, the boom assembly comprising an object-to-boom linkage mechanism; and a gondola separate from the movable portion and attached to the movable portion by the bridge arm, the bridge arm extending laterally outward from the station axis of rotation to space the gondola from the station axis of rotation and the fixed portion, the gondola comprising a user-to-machine interface, the gondola being pivotal in unison with the movable portion by way of the bridge arm, the gondola configured to rotate around the station axis of rotation and the fixed portion, the object-to-boom linkage mechanism configured to link at least one machine-movable object to the boom assembly, the boom assembly being maneuverable for lifting the at least one machine-movable object from the support surface by way of the user-to-machine interface as manually operated by the user.

12. The amusement activity station of claim 11 comprising a winch apparatus, the winch apparatus comprising a winch motor and a winch line, the winch motor and winch line for selectively varying the distance of the object-to-boom linkage mechanism relative to the boom assembly.

13. The amusement activity station of claim 11 wherein the boom assembly comprises a primary boom arm and a telescopic boom arm, the telescopic boom arm being extendable and retractable relative to the primary boom arm for adjusting an effective length of the boom assembly.

14. The amusement activity station of claim 11 comprising a rotational movement limit mechanism for limiting rotational movement of the movable portion relative to the fixed portion.

15. The amusement activity station of claim 14 wherein the rotational movement limit mechanism is characterized by at least one limit switch assembly.

16. The amusement activity station of claim 15 wherein at least one switch stop is mounted to the fixed portion and the at least one switch assembly is mounted to the movable portion.

17. The amusement activity station of claim 16 comprising a pair of switch stops, the switch stops being spaced from one another and mounted to the fixed portion for limiting rotational movement of the movable portion within a select arc range.

18. The amusement activity station of claim 11 wherein the gondola comprises at least one wheel for movement, wherein the bridge arm and the at least one wheel are configured to support the gondola atop the support surface.

19. The amusement activity station of claim 11 wherein the gondola comprises a shield feature, the shield feature providing a user-protective barrier between the user and the crane apparatus.

20. The amusement activity station of claim 19 wherein the shield feature comprises a grating, the grating preventing physical access to the crane apparatus while permitting visual perception of the crane apparatus.

* * * * *